US005695205A

United States Patent [19]

Liu

[11] Patent Number: 5,695,205

[45] Date of Patent: Dec. 9, 1997

[54] COMBINATION SHELVING

[76] Inventor: Cheng-Chia Liu, No.10, Sung-Chiang N. Rd., Chung-Li City, Taiwan

[21] Appl. No.: 582,398

[22] Filed: Jan. 3, 1996

[51] Int. Cl.[6] ..... B62B 3/02

[52] U.S. Cl. ..... 280/79.2; 280/47.35; 280/159; 280/79.3; 211/189

[58] Field of Search ..... 280/638, 35, 651, 280/659, 43, 47.34, 47.35, 47.41; 211/189, 194, 133; 108/144; 248/129

[56] References Cited

U.S. PATENT DOCUMENTS

| | | | |
|---|---|---|---|
| 3,272,528 | 9/1966 | Young et al. | 280/47.35 |
| 3,834,725 | 9/1974 | Luowi | 280/79.2 |
| 3,908,831 | 9/1975 | Brendgord | 280/47.35 |
| 4,620,637 | 11/1986 | Karashima | 280/47.35 |
| 4,913,453 | 4/1990 | Wagner et al. | 280/79.2 |
| 5,489,106 | 2/1996 | Engelking et al. | 280/47.35 |

*Primary Examiner*—Richard M. Camby
*Attorney, Agent, or Firm*—Bacon & Thomas

[57] ABSTRACT

The shelving comprises receiving troughs, with many supporting rods mounted between the upper and the lower receiving troughs to allow them to be piled one over another for being fixedly assembled with the engaging stubs on the bottom ends of the supporting rods inserting into the top location holes on their respective lower receiving troughs, each engaging stub has a protruding rib on one of its sides for firmer connection; the posts have rollers on the feet and with top holes thereon to allow insertion of the stubs, so that the shelving after assemblying can be pushed to move about; when disassembled, the receiving troughs can be fittingly lapped over one another, the supporting rods, also the posts, can be collected four in one group to form a cylinder shape, as is beneficial to saving space, shipping and storage.

2 Claims, 5 Drawing Sheets

COMBINATION SHELVING

BACKGROUND OF THE INVENTION

1. Field of the Invention

The present invention relates to an improved combination shelving which comprises a plurality of receiving troughs, supporting rods, posts and rollers, wherein, the supporting rods are in groups, each group of them are mounted between an upper receiving trough and a lower receiving trough, so that the receiving troughs can be piled one over another for being fixedly assembled, while the posts are provided on the corners at the bottom of lowermost receiving trough with the rollers provided on the bottom ends of the posts, the shelving after assemblying can thereby be convenient to be pushed to move about.

2. Description of the Prior Art

A conventional combination shelving in the markets has the structure as shown in FIG. 1, and is comprised of a plurality of receiving troughs 1 arranged in layers, a plurality of cylindrical supporting rods 2 mounted between an upper receiving trough and a lower receiving trough 1, and a plurality of posts 3. Wherein, the receiving troughs 1 each has a concave receiving space 11 with an opened access 12 on the front side thereof, a plurality of location holes 13 are provided at the corners on the top thereof, and a plurality of cylindrical stubs 14 are provided at the corners on the bottom thereof corresponding to the positions of the location holes 13. Connection of the cylindrical stubs 14 with the top ends of the cylindrical supporting rods 2 and connection of the bottom ends of the cylindrical supporting rods 2 with the location holes 13 provided at the corners on the top of another receiving troughs 1 allow the receiving troughs 1 to be piled in layers, and the lowermost receiving trough 1 with its bottom cylindrical stubs 14 connected to the top ends of the above mentioned posts 3 which stand on the ground forms the shelving together with the other receiving troughs 1 and the cylindrical supporting rods 2.

The conventional combination shelvings have the following disadvantages:

1. Connections of the top ends of the cylindrical supporting rods 2 with the cylindrical stubs 14 on the bottom of the receiving trough 1 and with the location holes 13 provided on the top of another receiving troughs 1 are all in a way of telescoping, they leave gaps therebetween, the upper and the lower receiving troughs 1 may therfore be unstable due to waving phenomenon, the more layers they form, the more seriousness is the waving phenomenon.

2. A combination shelving has the advantage of "do it yourself" by a user in assemblying, this increases mobility of the shelving. However, when in disassemblying of the conventional combination shelving, gaps between the cylindrical supporting rods 2 after collection thereof are quite large, space which can be saved is not much; while lapping of the receiving troughs 1 does not take advantage of the concave receiving spaces 11, very few space can be saved in storage, i.e., the shelving still occupies quite a large volume after disassemblying, and is not beneficial to storage as well as shipping.

SUMMARY OF THE INVENTION

In view of these, the inventor of the present invention designed a novel combination shelving to get rid of the disadvantages resided in the conventional combination shelvings. Particularly, the combination shelving is comprised of a plurality of receiving troughs, supporting rods, four posts and four rollers, wherein:

lengths of the top edges are slightly larger than those of the corresponding bottom edges of the concave receiving spaces in the receiving troughs, there are a plurality of top location holes and bottom stubs provided at the corners on of the receiving troughs, when the receiving troughs are piled one over another, each of the upper receiving troughs can be received in its corresponding lower receiving trough, meantime, the bottom stubs can be inserted into their corresponding top location holes on the lower receiving trough.

Each supporting rod is in a shape of ¼ cylinder, a top hole on the supporting rod can allow insertion of a bottom stub, an engaging stub of the same size as that of the bottom stub is provided on the bottom end thereof for inserting into a top location hole, the engaging stub has a protruding rib provided on one of its sides; therefore, when the supporting rods are collected for storing, every four supporting rods can be put together to make a cylinder shape.

Each post is also in a shape of ¼ cylinder, a top hole thereon can also allow insertion of a bottom stub, one of the above mentioned rollers can be mounted on the bottom end thereof, in the same way, when the four posts are collected for storing, they can be put together to make a cylinder shape.

The primary object of the present invention is to provide a novel combination shelving assembled with the above stated members, wherein, by mounting the supporting rods between the upper and lower receiving troughs, and by providing the posts with the rollers and beneath the bottom receiving trough, assemblying of the combination shelving can be completed, and when in assemblying, by the protruding ribs provided on the bottom ends of the supporting rods and snugly engaged in the location holes, all connections can be firmer, and the combination shelving can be pushed to move about due to providing of the rollers; after disassemblying, the receiving troughs can be lapped fittingly over one another, so that volume of the lapped members is reduced, and when the supporting rods are collected for storing, four supporting rods can be put together to make a cylinder shape and thus reduce space of gaps thereamong, i.e., space for storing can be saved. The present invention can have improvement such as making the assembly firmer, saving space in storing, and being beneficial to shipping as well as storage.

The present invention will be apparent in reading the detailed description of the preferred embodiment thereof in reference to the accompanying drawings.

DETAILED DESCRIPTION OF THE PREFERRED EMBODIMENT

Figure 1:
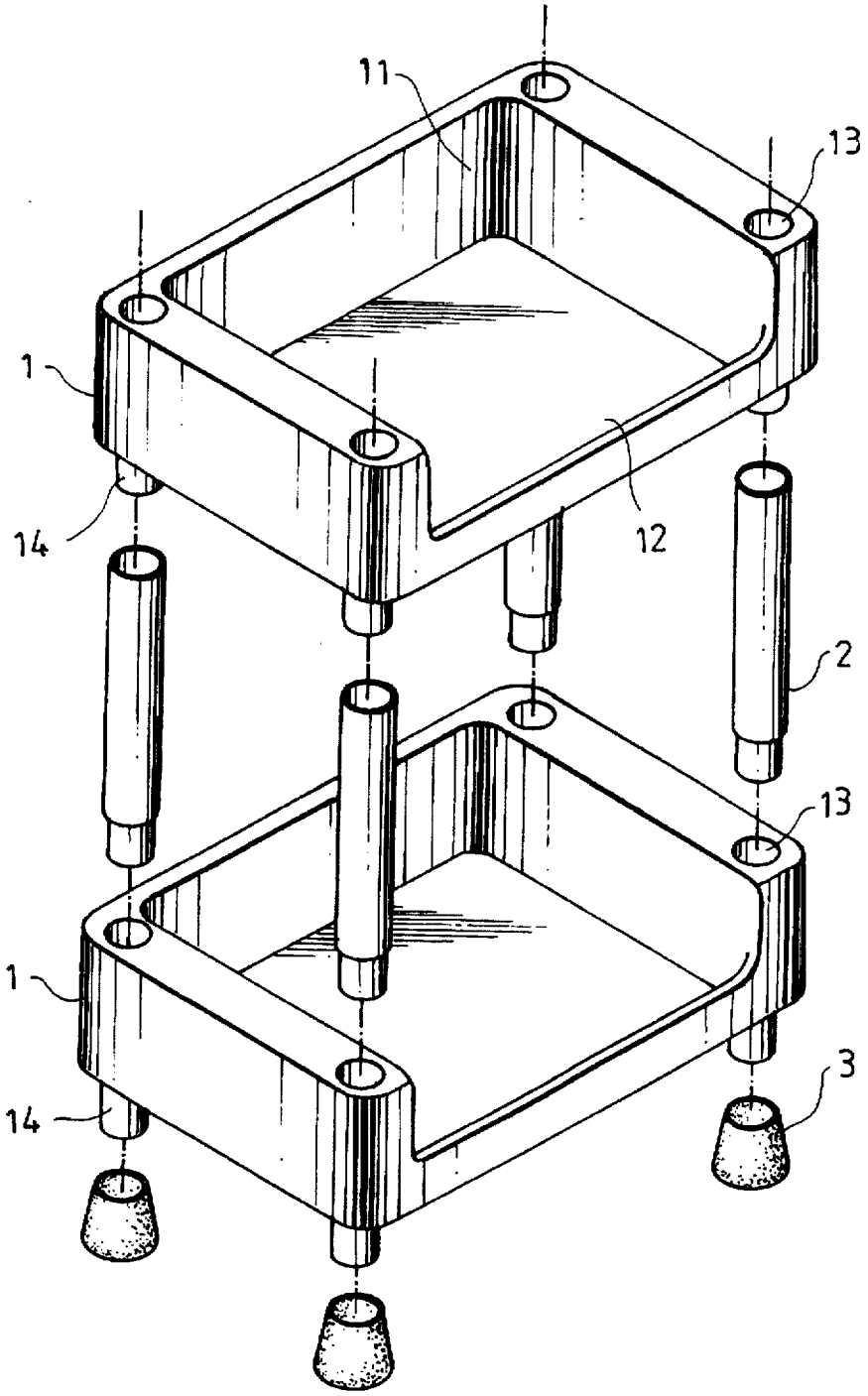
PRIOR ART Fig. 1
FIG. 1 is a perspective anatomic view of a conventional combination shelving of the prior art.
Figure 2:
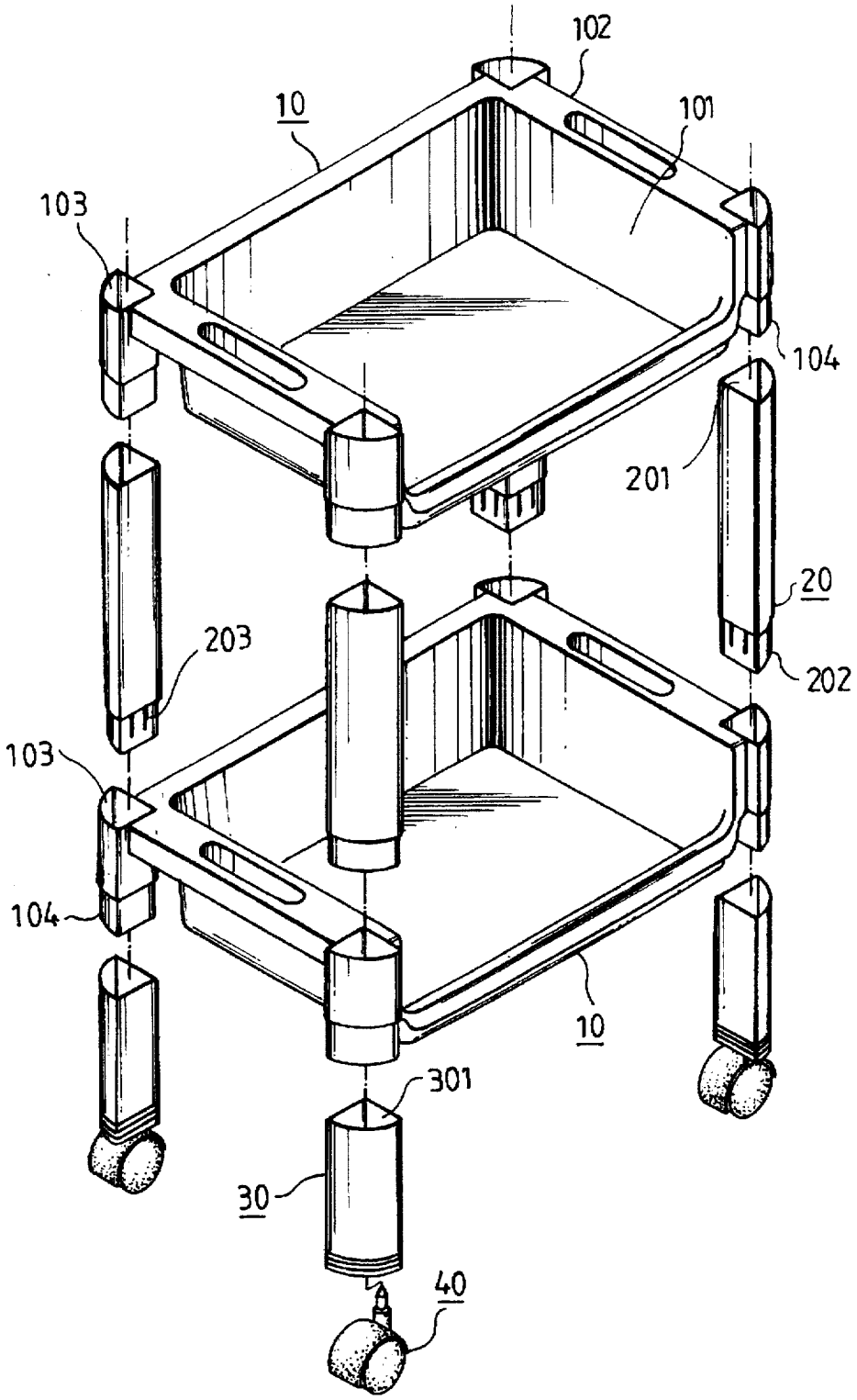
FIG. 2 is a perspective anatomic view of the present invention.
Figure 3:
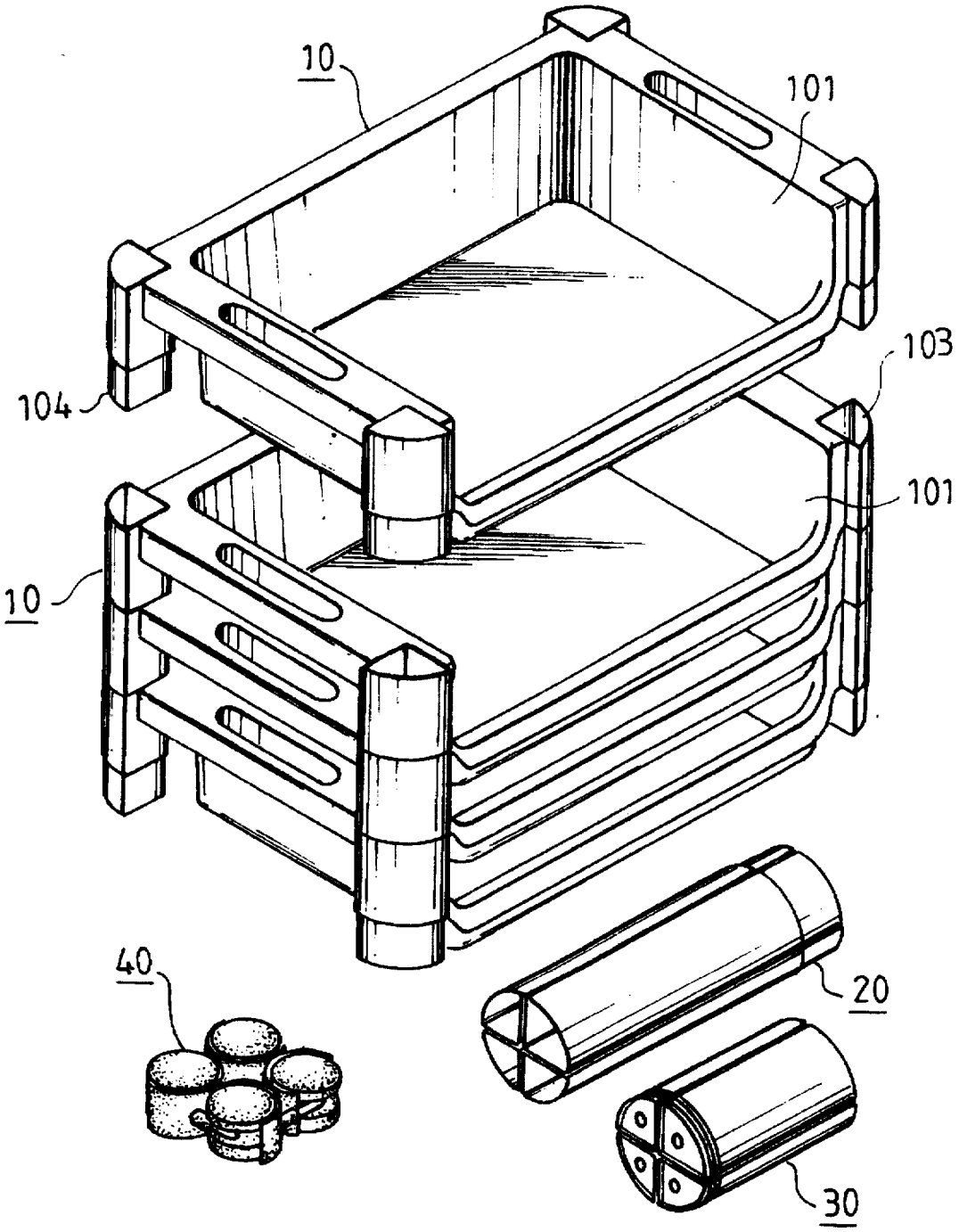
FIG. 3 is a schematic view of the present invention showing its disassemblying and collecting.
Figure 4:
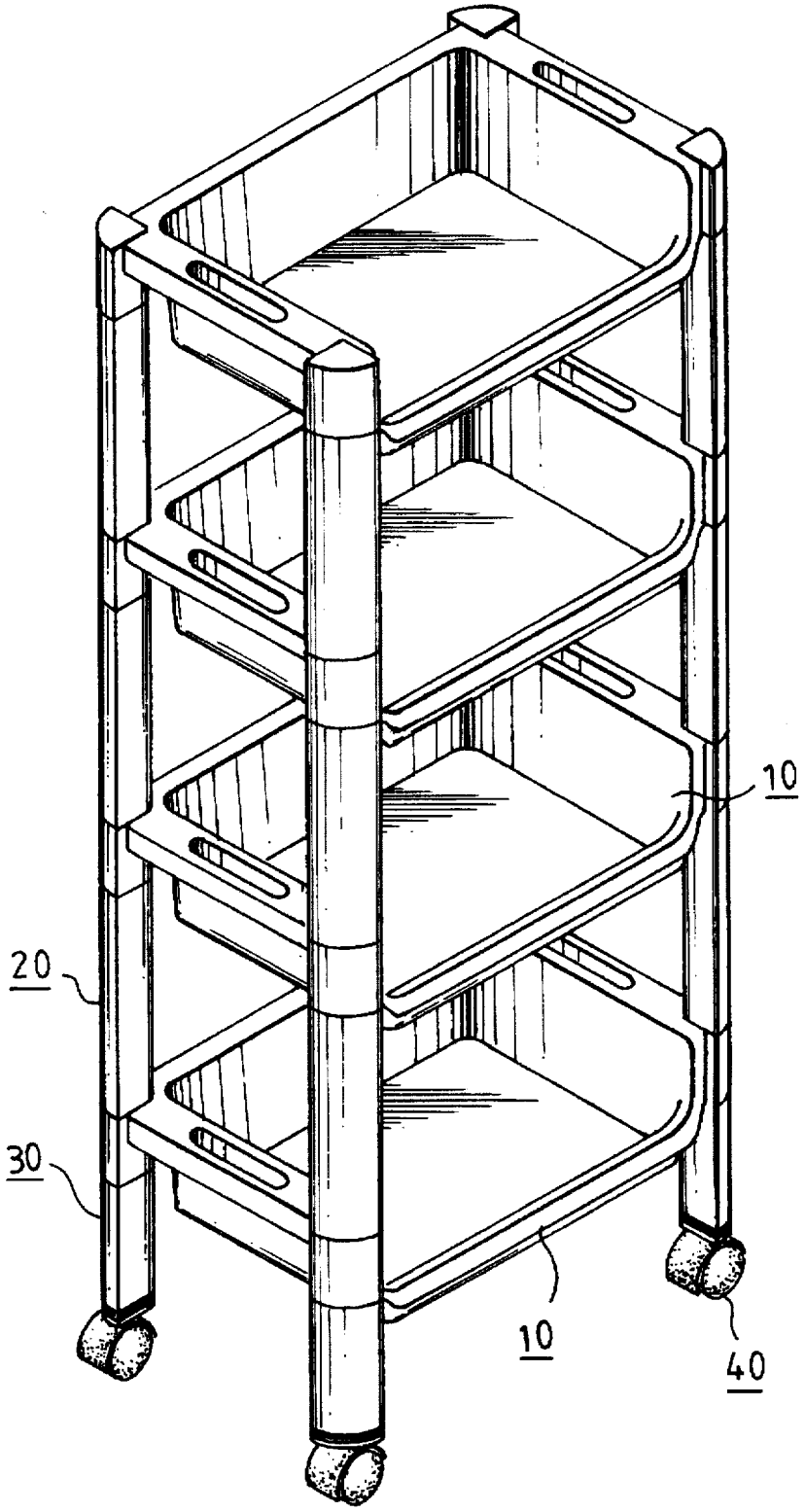
FIG. 4 is a perspective view of the present invention after assemblying.

We can see from FIG. 2 the members composing the present invention, the members include a plurality of receiving troughs 10, a plurality of supporting rods 20, four posts 30 and four rollers 40, wherein:

Quantity of the receiving troughs 10 depends on requirement of a user, each receiving trough 10 has a concave receiving space 101 of which lengths of the top edges are slightly larger than those of the corresponding bottom edges, and two flanges 102 are provided on the two lateral sides thereof, both ends of the two flanges 102, i.e., the four corners of the receiving trough 10 each is provided with a location hole 103, a plurality of stubs 104 are provided at the corners corresponding to the positions of the location holes 103 and on the bottom of the two flanges 102; when the receiving troughs 10 are lapped one over another, such as shown in FIG. 3, the bottom of each of the upper receiving troughs 10, i.e., the bottom of each concave receiving space 101 of which lengths of the bottom edges are slightly smaller than those of the corresponding top edges of the concave receiving space 101 of a lower receiving trough 10, so that the upper receiving trough 10 can be received in the concave receiving space 101 of the corresponding lower receiving trough 10, meantime, the bottom stubs 104 on the bottom of the upper receiving trough 10 can be inserted into the location holes 103 provided on the corresponding lower receiving trough 10, the upper receiving trough 10 and the corresponding lower receiving trough 10 therefore are fittingly lapped with each other to thereby reduce space of gaps therebetween.

The above mentioned supporting rods 20 are divided four in one group to be mounted between an upper receiving trough 10 and a lower receiving trough 10, so that quantity thereof can be varied according to quantity of the receiving troughs, each supporting rod 20 is in a shape of ¼ cylinder, a top hole 201 on the supporting rod 20 can allow insertion of a stub 104 provided on the bottom of an upper receiving trough 10 (as shown in FIG. 2, 4), an engaging stub 202 of the same size as that of the stub 104 is provided on the bottom end of the supporting rod 20 for inserting into a top location hole 103 provided on a lower receiving trough 10, the engaging stub 202 has a protruding rib 203 provided on one of its sides, the engaging stub 202 can thereby be snugly engaged in the location hole 103; when the supporting rods 20 are collected for storing with their arciform side facing outwardly (as shown in FIG. 3), every four supporting rods can be put together to make a cylinder shape.

Quantity of the posts 30, namely four, is equal to the quantity of the stubs 104 of the lowermost receiving troughs 10, each post 30 is also in a shape of ¼ cylinder as the supporting rods 20 are, a top hole 301 thereon can also allow insertion of a stub 104 provided on the bottom of lowrmost receiving trough 10 (as shown in FIG. 2, 4), a roller 40 is provided on the bottom end of the post 30; when the four posts 30 are collected for storing with their arciform side facing outwardly (as shown in FIG. 3) after disassemblying, they can be put together to make a cylinder shape.

With the above stated receiving troughs 10, supporting rods 20, four posts 30 and four rollers 40, we can mount the supporting rods 20, four in a group, between an upper and a lower receiving troughs 10, and the rollers 40 can be mounted on the feet of the posts 30 which are in turn mounted on the bottom of the lowermost receiving trough 10, assembly of the combination shelving of the present invention can thereby completed. After assemblying, with the protruding ribs 203 provided on the bottoms of the supporting rods 20, the engaging stubs 202 can be firmly engaged in the location holes 103 provided on every lower receiving trough 10 without a waving phenomenon; besides, with the rollers 40, the shelving of the present invention can be pushed to move about. While after disassemblying for storage, the receiving troughs can be lapped fittingly over one another, the concave receiving space 101 can be sufficiently used, so that volume of the lapped members is reduced; and when the supporting rods 20 and the posts 30 are collected for storing, every four supporting rods 20 or posts 30 can be put together to make a cylinder shape and thus reduce space of gaps thereamong, i.e., space for storing can be saved.

Figure 5:
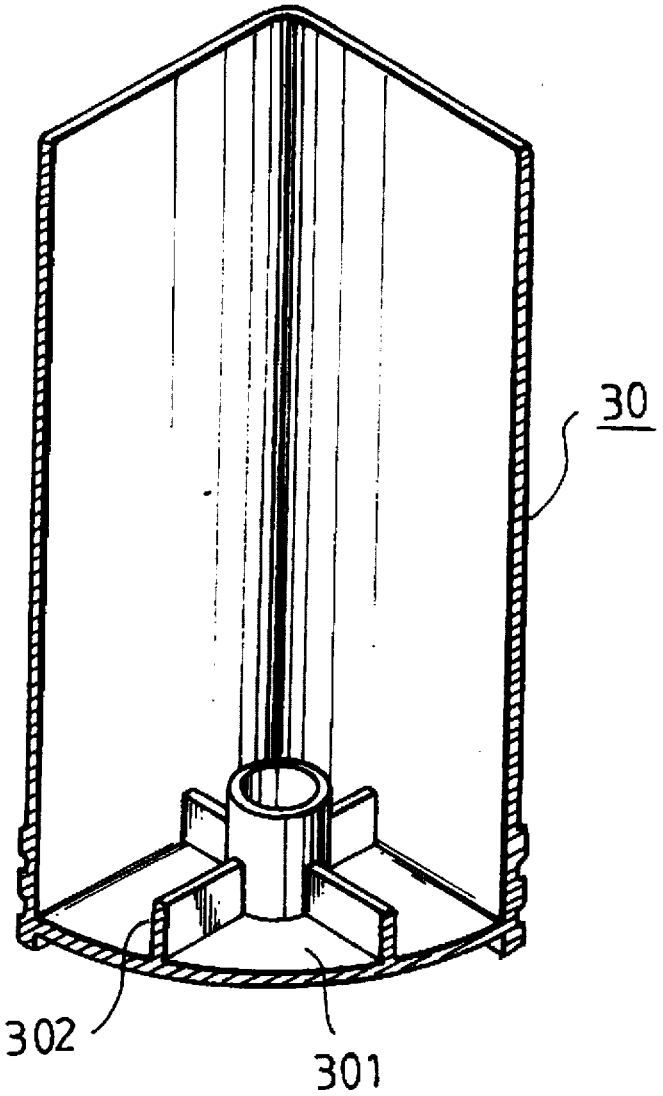
FIG. 5 is a sectional view of the posts of present invention.

Moreover, the posts 30 as stated above and shown in FIG. 5 are hollow posts, a plurality of reinforcing ribs 302 are provided on the upper bottom surface 301 thereof to enhance strength of the bottom surface 301 against breakage.

My invention may assume numerous forms and is to be construed as including all modifications and variations falling within the scope of the appended claims.

I claim:

1. A combination shelving comprising:

a plurality of concave receiving troughs, a plurality of location holes being provided on the top of each said receiving trough and being corresponding in position to a plurality of stubs on the bottom of said receiving trough, said stubs being able of inserting into a plurality of location holes provided on a corresponding lower receiving trough which is identical to said receiving trough;

a plurality of supporting rods, being mounted, four in one group, between an upper said receiving trough and a lower said receiving trough, a plurality of top holes on said supporting rods allowing insertion of said stubs provided on the bottom of said upper receiving trough, and a plurality of engaging stubs being provided on the bottom ends of said supporting rods for inserting into said top location holes provided on said lower receiving trough;

four posts having the similar shape as those of said supporting rods, a plurality of top holes thereon also allowing insertion of said stubs provided on the bottom of the lowermost receiving trough; said combination shelving is characterized by that:

lengths of the top edges of said receiving troughs are slightly larger than those of the corresponding bottom edges thereof, so that an upper said receiving trough can be received in the concave receiving space of a lower said receiving trough;

said engaging stubs provided on the bottom ends of said supporting rods each has a protruding rib provided on one of its sides, said engaging stubs can thereby be snugly engaged in said location holes;

said supporting rods are in the shape of ¼ cylinder, so that when said supporting rods are collected for storing with their arciform sides of said ¼ cylinder shapes facing outwardly, every four of said supporting rods can be put together to make a whole cylinder shape;

said four posts has the same ¼ cylinder shape as that of said supporting rods, so that when said posts are collected for storing with their arciform sides of said ¼ cylinder shapes facing outwardly, every four of said posts can be put together to make a whole cylinder shape;

four rollers are provided on the feet of said posts, so that said combination shelving after completion of assemblyinbg can be pushed to move about.

2. A combination shelving as claimed in claim 1, wherein said posts are hollow posts, a plurality of reinforcing ribs are provided on the upper bottom surface thereof.

* * * * *